United States Patent [19]

Taylor et al.

[11] Patent Number: 5,015,147

[45] Date of Patent: May 14, 1991

[54] EXCAVATING APPARATUS

[76] Inventors: Peter J. Taylor; Randall P. Taylor, both of R.R. 1, Smithville, Ontario, Canada, L0R 2A0

[21] Appl. No.: 353,583

[22] Filed: May 18, 1989

[30] Foreign Application Priority Data

May 18, 1988 [CA] Canada ..... 567124

[51] Int. Cl.[5] ..... B66C 23/78

[52] U.S. Cl. ..... 414/685; 180/8.6; 212/189; 280/765.1; 280/43.24; 414/694; 414/718

[58] Field of Search ..... 414/694, 718; 212/189; 280/764.1, 765.1, 766.1, 43.24; 180/8.6, 8.1

[56] References Cited

U.S. PATENT DOCUMENTS

| | | | |
|---|---|---|---|
| 1,676,645 | 7/1928 | Funk . | |
| 2,436,799 | 3/1948 | Frost . | |
| 2,706,120 | 4/1955 | Stratton . | |
| 3,150,733 | 9/1964 | Goebel | 180/8.1 |
| 3,244,301 | 4/1966 | Vaughan . | |
| 3,310,181 | 3/1967 | Symmank . | |
| 3,351,221 | 9/1965 | Smalley . | |
| 3,433,374 | 3/1969 | Menzi . | |
| 3,545,657 | 12/1970 | LeTourneau . | |
| 3,635,364 | 1/1972 | Tingleff . | |
| 3,638,805 | 2/1972 | Garnier . | |
| 3,700,115 | 10/1972 | Johnson et al. . | |
| 3,768,674 | 10/1973 | Menzi . | |
| 3,791,530 | 2/1974 | Gorl et al. . | |
| 3,989,149 | 11/1976 | Smith et al. . | |
| 4,118,054 | 10/1978 | Vigerie | 280/765.1 |
| 4,245,855 | 1/1981 | Larson | 280/765.1 |

FOREIGN PATENT DOCUMENTS

| | | | |
|---|---|---|---|
| 138040 | 10/1981 | Japan | 212/189 |

*Primary Examiner*—Frank E. Werner
*Assistant Examiner*—Donald W. Underwood
*Attorney, Agent, or Firm*—Rogers & Scott

[57] ABSTRACT

Excavating apparatus of limited mobility adapted primarily for indoor use on brick or cement floors and having a body adapted to make substantially planar contact with the floor. The apparatus is stabilized by at least one pair of legs having respective retractile feet spaced from the body and respective, substantially planar pads connected to the free ends of the feet. The legs are also pivotally attached at an inner end remote from the pads to respective sides of the apparatus for lateral rotation towards and away from each other so as to vary the distance separating the feet.

4 Claims, 1 Drawing Sheet

EXCAVATING APPARATUS

Figure 1:
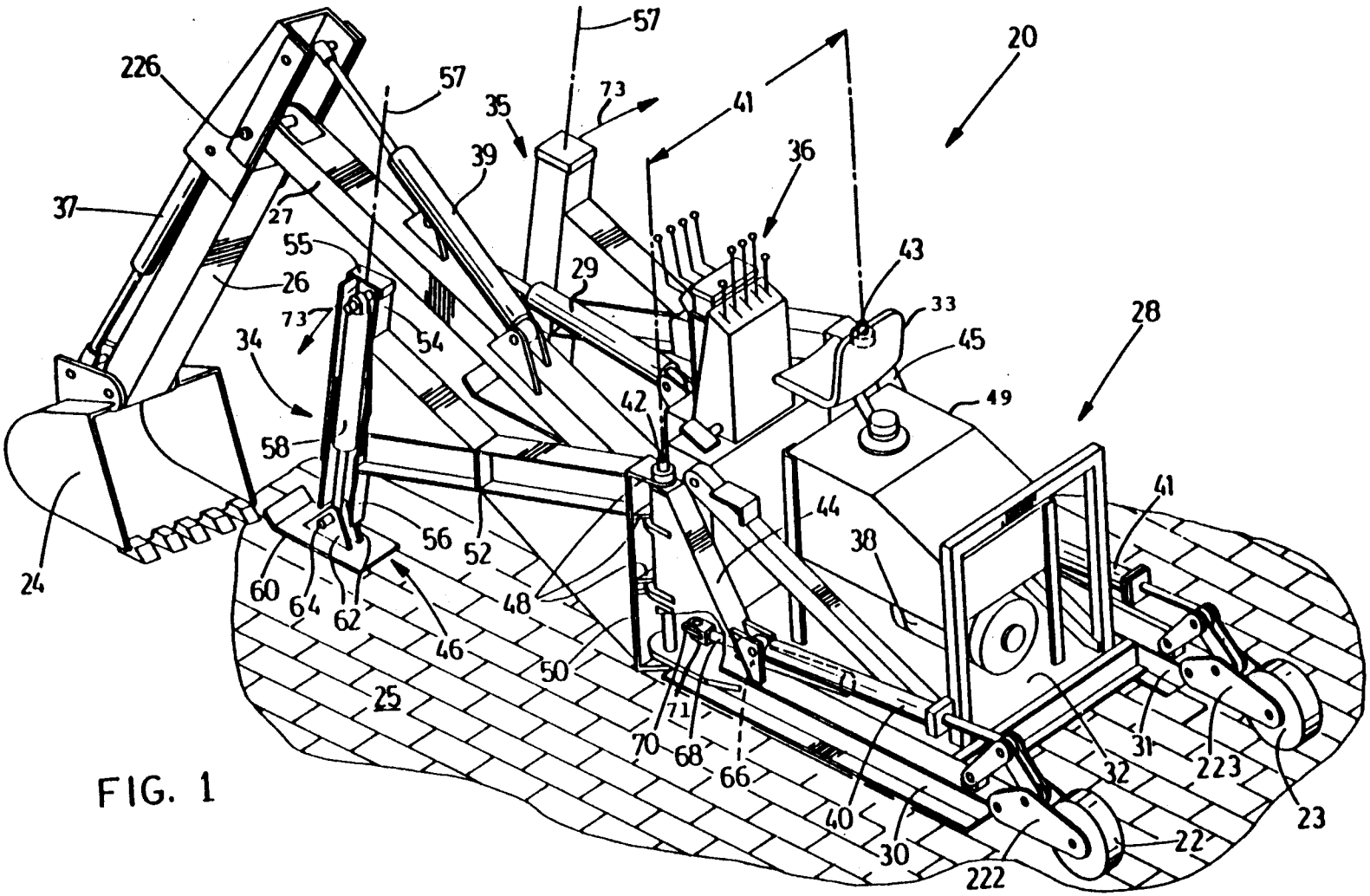

This invention relates to excavating apparatus of limited mobility adapted primarily for indoor use on brick or cement surfaces and is popularly known as a "backhoe". Such apparatus may be used for example to dig out a refractory lining in a reverberatory furnace with an excavating implement such as a bucket or demolition hammer. Such apparatus must be sufficiently stable to sustain digging forces without any risk of toppling.

The problem of balancing excavating apparatus generally is well known and it is now common practice to provide such apparatus with auxiliary ground engaging supports which extend outwardly on opposite sides of the apparatus like outriggers. The supports usually include a pair of legs pivotally attached to the apparatus for rotation about horizontal pins between a ground engaging configuration and a stowed configuration where they do not engage the ground. The legs may also be pivotable about vertical pins to adjust the width of the base defined by the relative spacing of the legs. The development of the art in this field may be typified by the following patents: U.S. Pat. No. 2,436,799; U.S. Pat. No. 3,244,301; U.S. Pat. No. 3,310,181; U.S. Pat. No. 3,351,221; U.S. Pat. No. 3,433,374; U.S. Pat. No. 3,768,674; and U.S. Pat. No. 3,989,149.

U.S. Pat. No. 3,989,149 to Smith et al, discloses auxiliary support means for a "stationary" backhoe of the type used for similar applications as the present invention. The apparatus is not automotive and must be moved to a work site by towing or with a crane. It includes a platform having a low centre of gravity and the support means are provided in the form of spaced parallel extensions pivotally mounted on opposite sides of the apparatus to side members forming part of the platform. The extensions and the side members are orientable to form a substantially flat ground engaging plane so as to minimize any damage which may occur to a brickwork floor when the apparatus is used indoors.

Unfortunately, the advantage of providing plane surface contact between the apparatus and the supporting floor is lost whenever the extensions are pivoted downwardly and the extensions and the platform form an inverted "V". This configuration is adopted to elevate the platform and facilitate manoeuvering of the "stationary" backhoe by pulling against the bucket or other ground engaging implement to move the platform around obstacles such as a furnace door. The consequent reduction in the surface area of the bearing surface results in point loading on the ends of the extensions and the ends of the platform remote from the extensions and can be very damaging, particularly where the floor is made of concrete or brick. This occurs even for small changes in elevation of the apparatus. Another consequence of the reduction in the area of the bearing surface is that the apparatus may become unstable. The long and low extensions are also more prone to encounter obstacles on uneven supporting surfaces so that the inclination and stability of the platform may be adversely affected even where the surface adjacent the platform itself may be substantially flat and free from irregularities.

Another disadvantage of the apparatus described in the patent to Smith is that considerable stress is borne by the pivot pins connecting the extensions to the platform when the inverted "V" configuration is adopted.

Also, any change in elevation of the platform results in slippage or drag of the extensions and this too may cause damage to the supporting surface. Because slippage is not controlled and may occur at different ends and on opposite sides of the apparatus, a jerky movement may result which can unbalance the apparatus. Finally, it will be noted that the extensions are movable relative to the platform by means of hydraulic actuators. The actuators are exposed to blows from falling objects and dirt and considerable maintenance may be necessary, particularly in harsh environments, to keep them in an operable condition.

The object of this invention is to provide a stabilizer for an excavating apparatus which will alleviate to some extent at least some of the problems described above with reference to U.S. Pat. No. 3,989,149 to Smith.

In accordance with this invention, there is provided an excavating apparatus in which the body makes substantially planar contact with a supporting surface so as to minimize any damage to the surface. The apparatus includes a stabilizer comprising at least one pair of legs having respective retractile feet spaced from the body and which make substantially planar contact with the supporting surface when extended so that a constant bearing area is maintained at the feet irrespective of the degree of extension of the feet relative to the body. As usual, the legs are pivotally attached to respective sides of the body for lateral rotation towards and away from each other so that the distance separating the feet and the effective width of the body may be varied for increased stability of the apparatus.

In a preferred embodiment, the foot includes co-axial telescoping sleeves movable relative to each other by means of a hydraulic actuator connecting the sleeves to each other and received within the sleeves. In this way, the means for extending the feet are protected from dirt and blows.

A preferred embodiment of the invention is described below with reference to FIG. 1 which is a perspective view of the apparatus.

Referring to FIG. 1, an apparatus according to the invention is indicated generally by reference numeral 20. The apparatus 20 is of a "stationary" type and is positioned at a working site either by means of a crane or by towing the apparatus in an inclined position with a pair of wheels 22, 23 attached to the rear of a body 28 comprising the apparatus pivoted downwardly from the position illustrated so that they engage a supporting surface or floor 25. Limited automotive mobility of the apparatus can be achieved by pushing or pulling against a scoop 24 or other excavating implement connected to the front of the apparatus.

The scoop 24 is provided at the free end of a hydraulically actuated jib 26 pivotally attached for vertical movement about a pivot pin 226 connecting the jib to a boom 27. The boom 27 in turn is pivotally attached by a universal joint (not shown) to the front of the body 28.

Laterally spaced skids 30, 31 form part of the body 28 and are located to either side of the body in supporting engagement with a base 32 so as to make substantially planar contact with the floor 25.

The scoop 24 and jib 26 are movable by respective hydraulic actuators 37, 39 operatively connected to controls 36 conveniently located for access by an operator seated on a chair 33 provided on the body 28. Similarly, the boom 27 is movable by a respective hydraulic actuator 29. Respective supports 222, 223 for the wheels 22, 23 are likewise movable to bring the wheels into and out of engagement with the floor 25 by respective hydraulic actuators 40, 41 operated at the controls 36. A pump unit 38 for the hydraulic acutators is mounted to the base 32 beneath a hydraulic oil reservoir 49 and behind the controls 36. In FIG. 1 all hydraulic feed lines have been omitted for simplicity and clarity of illustration.

A pair of forwardly extending legs 34, 35 define a stabilizer for the apparatus 20 when it is used in a substantially stationary mode, that is, when the apparatus is at a work site in a position to work the earth or dig a furnace and the like and is not being towed or moved with a crane. The legs 34, 35 are pivotally attached at an inner end for lateral rotation about axes 41 at respective upward posts 42, 43 mounted to the skids 30, 31 and located in respective braces 44, 45 forming part of the body 28. The legs 34, 35 are rotatable about the posts 42, 43 toward and away from each other so as to vary the distance separating respective retractile feet 46, 47 (only one of which is shown in FIG. 1) located at the outer end of each leg. While the description which follows is made with particular reference to the leg 34, it will be understood that corresponding parts form part of the leg 35.

The connection between the leg 34 and the associated upward post 42 is made by a series of apertured lugs 48 welded to an upright member 50 forming part of the leg 34 and located at the inner end of the leg. A brace 52 including an I-beam and welded plates connects the upright member 50 to the foot 46 at the forward part of the leg 34 and is located between the foot and the body 28 so as to space the foot from the body.

The foot 46 includes an upwardly extending outer sleeve 54 closed at the top by an end cap 55 and positioned to receive an inner sleeve 56 extending downwardly in telescoping fashion. The sleeves 54, 56 define an axis 57 which is inclined from the vertical such that a projection of this axis will meet the projection of the corresponding axis 41. The sleeves in the feet 46, 47 are movable relative to one another by means of respective hydraulic actuators 58, 59, fixed to and received within the sleeves. In FIG. 1, the foot 46 is partly broken away to expose the actuator 58. The actuator 59 associated with the foot 47 is not shown.

A pad 60 which is substantially flat and has an upwardly curved front end resembling a ski is pivotally connected for upward rotation at the lower end of the inner sleeve 56. The connection between the pad and the foot is made by a generally horizontal pivot pin 64 received in apertures provided in a connecting portion comprising a pair of upwardly extending flanges 62 attached to the pad 60, and corresponding apertures (not shown) provided in a lower portion of the inner sleeve 56.

Lateral movement of the leg 34, 35 is accomplished by respective hydraulic actuators 66, 67 supported on the body 28. Only the actuator 66 associated with the leg 34 is shown in ghost outline in FIG. 1. The actuator 67 is hidden from view. The piston rod 68 associated with the actuator 66 is attached to a pivot joint 71 which receives a lug 70 attached to the post 50 and thereby operates to swing the legs in an arc in front of the apparatus as indicated by arrows 73.

In use, the apparatus is brought to a work site by towing or with a crane. Limited mobility at the work site is achieved by anchoring the scoop 24 and pulling or pushing against it. During excavation and such manoeuvering of the apparatus around obstacles and the like, the apparatus is subject to transverse forces which may unbalance the apparatus and cause it to topple.

The stabilizer according to the invention is employed to increase the effective width of the apparatus, as required, by operating the actuators 66, 67 as described above to rotate the legs 34, 35 independently of each other about the posts 42, 43. To make allowances for differences in the relative elevation of the skids 30, 31 supporting the body 28 and the scoop 24, the feet 46, 47 at the forward end of the legs are retracted or extended as required by operation of the actuators 58, 59. The pads at the end of the feet will pivot to conform to local variations in the inclination of the supporting surface and make substantially planar contact so as to minimize any damage where the supporting surface is a brickwork floor.

The stabilizer defined by the legs 34, 35 makes substantially planar contact with the floor irrespective of whether the skids 30, 31 are resting on the floor with the feet in a retracted configuration or the skids are raised relative to the floor by extending the feet 46, 47. Moreover, because the length of the legs 34, 35 is adjustable to compensate for any changes in the height of the body 28 relative to the floor 25, any drag of the pads relative to the floor is reduced together with any consequent damage this might cause. This results in a more controlled and minimized sliding action so that toppling of the apparatus is less likely to occur. Also, because the feet are spaced from the body, it will also be appreciated that any obstacles lying in the path between the skids 30, 31 and the associated feet 46, 47 are less likely to come into engagement with the legs 34, 35 as they would in the apparatus described in U.S. Pat. No. 3,989,149 to Smith et al and so are less likely to affect the stability of the apparatus.

Still further advantages of the stabilizer according to the invention include ease of maintenance because the hydraulic actuators 58, 59 for extending the feet 46, 47 are shielded in their respective sleeves and are less susceptible to blows from falling objects or dirt. Finally, the elevation of the apparatus may be adjusted without placing excessive stress on the posts (42, 43) connecting the legs to the body.

What is claimed is:

1. An excavating apparatus comprising:

a body having a pair of side skids;

an excavating implement mounted on the body between the skids;

a pair of stabilizer legs mounted one to either side of the excavating implement on the body, the legs being mounted on respective vertical axes for movement horizontally about the axes;

a pair of pads;

means mounting the pads on the legs for reciprocal movement along respective inclined axes, the projections of which meet projections of the corresponding said vertical axes; and actuator means coupled to the skids, legs and pads and operable selectively to elevate and move the apparatus.

2. Apparatus according to claim 1, in which the means mounting a pad to the associated leg comprises a hydraulic actuator having one end fixed to the pad and the other end fixed to the leg, the ends of the actuator being housed in respective coaxial telescoping sleeves.

3. Apparatus according to claim 1 in which the legs include a brace whereby the means mounting the pads on the legs are spaced from said vertical axes so that said projections meet at a point above the apparatus.

4. An excavating apparatus including a body adapted to make substantially planar contact with a supporting surface and to have an excavating implement attached thereto, the apparatus including a stabilizer comprising at least one pair of legs having respective retractile feet and including substantially planar pads connected to a free end of each foot, the legs being pivotally attached at an inner end remote from the pads to respective sides of the body for lateral rotation toward and away from each other so as to vary the distance separating the feet, each foot defining an axis which is inclined from the vertical and being movable between an extended configuration in which the respective pad engages the supporting surface and a retracted configuration in which the pad is removed from the supporting surface.

* * * * *